US005474521A

United States Patent [19]

Yang

[11] Patent Number: 5,474,521

[45] Date of Patent: Dec. 12, 1995

[54] FOOT SOLE MASSAGER

[76] Inventor: Hsi-Hsin Yang, 3F., 28, Lane 19, Chung Yang Rd., Sec. 2, Sanchung, Taipei, Taiwan

[21] Appl. No.: 246,716

[22] Filed: May 20, 1994

[51] Int. Cl.[6] ..... A61H 15/00

[52] U.S. Cl. ..... 601/126; 601/122; 601/127

[58] Field of Search ..... 601/24, 27–32, 601/115–118, 122, 126–128, 136, 120, 125; 482/54, 79, 56

[56] References Cited

U.S. PATENT DOCUMENTS

| | | | |
|---|---|---|---|
| D. 185,246 | 5/1959 | Taran | 601/119 X |
| 614,306 | 11/1898 | Mason | 601/115 X |
| 872,126 | 11/1907 | Hart | 601/123 X |
| 1,064,968 | 6/1913 | Hagen | 482/54 |
| 1,671,019 | 5/1928 | Falck | 601/125 |
| 1,882,490 | 10/1932 | Falck | 601/120 |
| 2,030,358 | 2/1936 | Dorrance | 601/118 X |
| 2,230,890 | 2/1941 | McClenathen | 601/122 |
| 2,944,543 | 7/1960 | Newcombe | 601/122 X |
| 3,083,709 | 4/1963 | Lenysfeld | 601/126 |
| 3,205,888 | 9/1965 | Stroop | 601/115 X |
| 3,774,597 | 11/1973 | Root | 601/27 |
| 4,113,246 | 9/1978 | Gibbs | 601/122 X |
| 4,192,296 | 3/1980 | St. Mary | 601/116 X |
| 4,267,610 | 5/1981 | Blakeway et al. | 601/115 X |
| 4,342,452 | 8/1982 | Summa | 482/54 |
| 4,635,928 | 1/1987 | Ogden et al. | 482/54 |
| 4,751,918 | 6/1988 | Bernard et al. | 601/115 |
| 4,865,313 | 9/1989 | Kuo | 482/54 |
| 4,892,090 | 1/1990 | Kaeser | 601/122 X |
| 5,054,472 | 10/1991 | Stefan | 601/116 |
| 5,176,598 | 1/1993 | Gardner | 601/31 X |

FOREIGN PATENT DOCUMENTS

| | | | |
|---|---|---|---|
| 2741272 | 3/1978 | Germany | 601/29 |
| 2831132 | 1/1979 | Germany | 601/122 |
| 627641 | 1/1982 | Switzerland | 601/122 |
| 1230597 | 5/1986 | U.S.S.R. | 601/122 |
| 1570725 | 6/1990 | U.S.S.R. | 601/122 |

*Primary Examiner*—Robert A. Hafer
*Assistant Examiner*—Brian E. Hanlon
*Attorney, Agent, or Firm*—Beveridge, DeGrandi, Weilacher & Young

[57] ABSTRACT

A foot sole massager includes a machine base supported on the ground by stands. A center opening is provided in the base, and two handrails extend upward at two opposite sides. Two lines of different massaging rods are arranged within the center opening. A first massaging rod includes plurality of raised portions, and a second massaging rod includes a plurality of tubular portions arranged in parallel. Each tubular portion includes a through hole, so that the second massaging rod is elastically deformable. A slide plate is disposed in contact with the massaging rods, and a motor is controlled to reciprocate the slide plate through an eccentric wheel and a link, causing the slide plate to turn the massaging rods to massage the user's soles. An adjusting mechanism is provided to change the turning angle of the massaging elements.

20 Claims, 4 Drawing Sheets

FOOT SOLE MASSAGER

BACKGROUND OF THE INVENTION

The present invention relates to massaging apparatus, and more particularly relates to a foot sole massager for massaging the user's soles.

It has been known that giving a massage to the muscles and joints of the body can make them work better. Various massaging devices have been disclosed, and have appeared on the market for massaging different parts of the body. Regular sole massaging apparatuses are commonly molded from rigid plastics having small raised portions for stimulating the acupuncture points of the sole. This type of sole massaging apparatus cannot gently knead the muscles and joints of the foot in stimulating blood circulation. While massaging, the sole may ache. There is also known a kind of walking path having stones projecting over the top. When walking on the walking path, the soles are massaged. However, this kind of walking path cannot eliminate the drawbacks of the aforesaid sole massaging apparatus.

SUMMARY OF THE INVENTION

The present invention has been accomplished under the circumstances described above. It is one object of the present invention to provide a foot sole massager which can effectively rub and knead the muscles and joints of the foot to make them work better. It is another object of the present invention to provide a foot sole massager which can be conveniently adjusted to rub the sole at a different frequency.

To achieve the aforesaid objects, there is provided a foot sole massager comprised of a flat machine base supported on the ground by stands thereof and having a center opening and two handrails at two opposite sides. Two lines of different massaging rods are arranged within the center opening, and a slide plate is disposed in contact with the massaging rods. A motor is controlled to reciprocate the slide plate through an eccentric wheel and a link cause the slide plate to turn the massaging rods in massaging the user's soles. An adjusting mechanism may be controlled to change the turning angle of the massaging elements.

BRIEF DESCRIPTION OF THE DRAWINGS

The present invention will now be described Inlay way of example with reference to the annexed drawings, in which.

DETAILED DESCRIPTION OF THE PREFERRED EMBODIMENT

Figure 1:
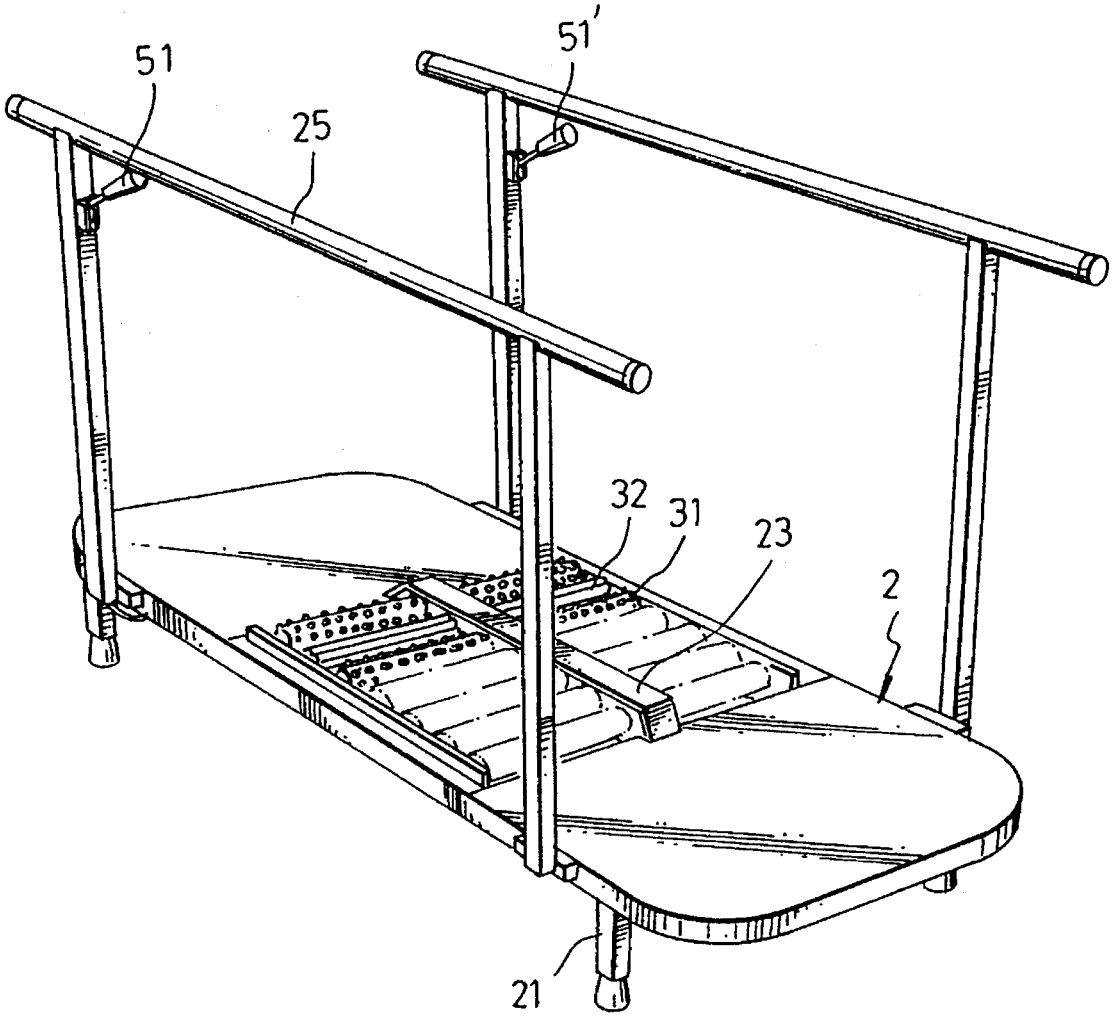
FIG. 1 is a perspective view of a foot sole massager according to the present invention.
Figure 2:
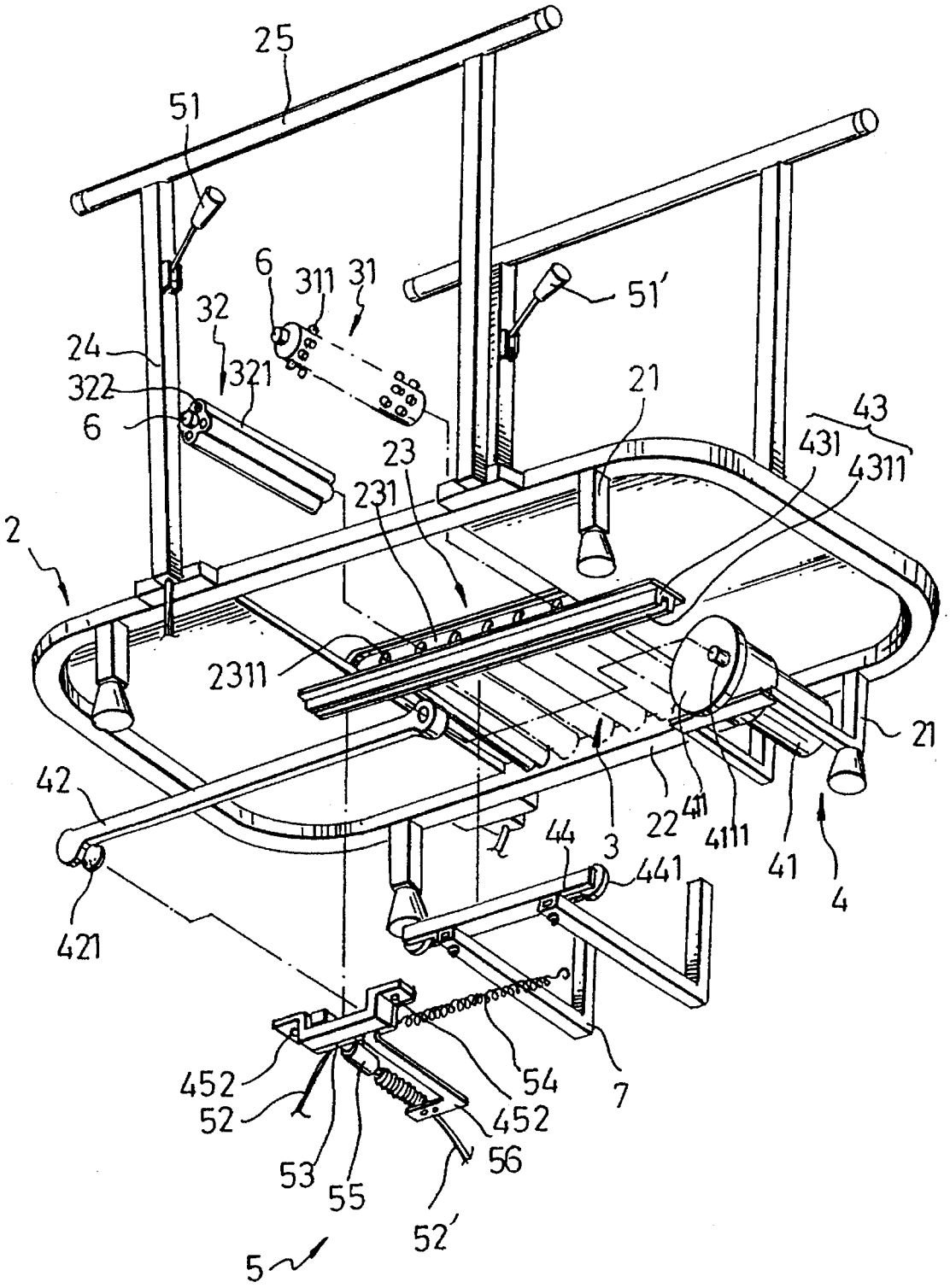
FIG. 2 is an exploded view of a foot sole massager according to the present invention.

Referring to FIG. 1 and FIG. 2, a foot sole massager in accordance with the preferred embodiment of the present invention is generally comprised of a machine base 2, a massaging unit 3, a driving mechanism 4, and an adjusting mechanism 5. The driving mechanism 4 and the adjusting mechanism 5 are mounted on the machine base 2 at the bottom. The machine base 2 comprises four stands 21 at the four corners thereof for supporting the massager on the ground, a substantially rectangular guard frame 23 is longitudinally disposed in a center opening of the machine base 2 in the middle in parallel with two opposite side frames 22 of the machine base 2, which guard frame 23 includes a plurality of through holes 2311 on the body 231 thereof respectively aligned with holes (not shown) on the side frames 22. Two symmetrical pairs of uprights 24 respectively are raised from the side frames 22 to support a respective handrail 25.

Referring to FIG. 2 again, the massaging unit 3 includes a plurality of first massaging rods 31 and a plurality of second massaging rods 32 respectively molded from rubber. The first and second massaging rods 31 and 32 are respectively mounted between either side frame 22 and the guard frame 23 by revolving axles 6. Each second massaging rod 32 is comprised of a plurality of tubular portions 321 linked in parallel, each tubular portion 321 having a longitudinal through hole 322. Therefore, when the second massaging rods 32 are rotated to rub the foot, the foot does not ache. Each first massaging rod 31 comprises a plurality of small raised portions 311 spaced over the periphery. The small raised portions 311 may be made of different sizes and spaced from one another at different pitches to provide different massaging effects.

Referring to FIG. 1, when in use, the user holds the handrails 25 with the hands and then steps on the first massaging rods 31 or the second massaging rods 32 as desired. When stepping on the first massaging rods 31 or the second massaging rods 32, the massaging rods 31 or 32 are turned to rub the sole of the foot. Because the second massaging rods 32 are molded from rubber having a plurality of longitudinal through holes, they provide satisfactory elastic deformation power to effectively massage the sole of the foot without causing the sole to ache.

Figure 3:
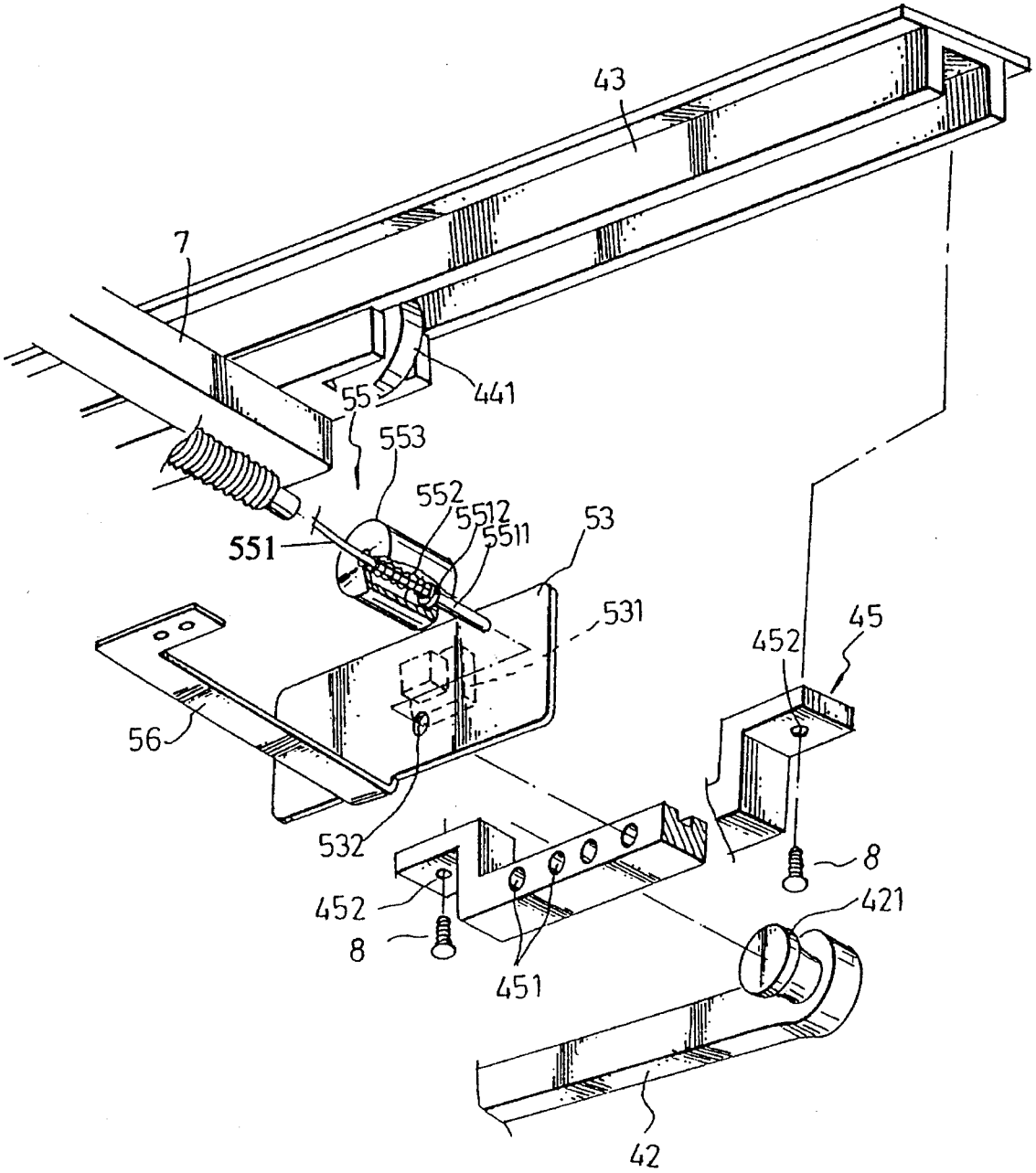
FIG. 3 is an exploded view of the adjusting mechanism of the foot sole massager shown in FIG. 2.

Referring to FIG. 2, the driving mechanism 4 is mounted on the machine base 2 at the bottom. This driving mechanism is comprised of a motor 41, an eccentric wheel 411, a link 42, a slide plate 43, a track 44, and a transmission plate 45 (see also FIG. 3). The track 44 is made from a channel plate mounted between two supporting frames 7 and disposed beneath the center opening of the machine base 2, having rollers 441 mounted on the inside. The slide plate 43 has a longitudinal groove 4311 through the length of a bottom rail 431 thereof and supported on the rollers 441 the track 44. Therefore, the slide plate 43 can be reciprocated on the track 44. The top wall of the slide plate 43 is made from friction material and disposed is in contact with the massaging unit 3. When the slide plate 43 is moved, the first and second massaging rods 31 and 32 are rotated. The transmission plate 45 has two mounting holes 452 vertically disposed on two opposite ends thereof and respectively fastened to the bottom rail 431 of the slide plate 43 at the bottom by screws 8, and a series of holes 451 horizontally aligned on one side thereof and equally vertically spaced from the bottom rail 431 of the slide plate 43. The motor 41 is mounted on the machine base 2 at the bottom. The eccentric wheel 411 is coupled to the power output terminal of the motor 41, having an eccentric shaft 4111 coupled with the link 42. The opposite end of the link 42 is mounted with a roller 421. The roller 421 of the link 42 is mounted within the transmission plate 45. Therefore, when the motor 41 is turned on, the link 42 is reciprocated by the eccentric wheel 411 causing the transmission plate 45 and the slide plate 43 to move back and forth horizontally.

Referring to FIG. 2 and FIG. 3 again, the adjusting mechanism 5 is mounted on the machine base 2 at the bottom. This adjusting mechanism 5 includes a first control lever 51, a second control lever 51', a first steel rope 52, a second steel rope 52', a movable locating plate 53, a spring 54, and a clutch member 55. The movable locating plate 53 has a projecting block 531 raised from the front surface thereof and inserted into the transmission plate 45 at an opposite side (relative to the roller 421 of the link 42). The spring 54 has one end connected to one end of the movable locating plate 53 and an opposite end connected to the bottom rail 431 of the slide plate 43. The opposite end of the movable locating plate 53 is connected to one steel rope, namely, the first steel rope 52. The opposite end of the first steel rope 52 is connected to the first control lever 51. Through the first control lever 51, the position of the movable locating plate 53 is controlled. There is a L-shaped positioning plate 56 perpendicularly welded to the movable locating plate 53 at the back. The movable locating plate 53 further includes a pin hole 532 for mounting the clutch member 55. The clutch member 55 comprises a rod 551, a spring 552, and a hood 553. The rod 551 is inserted through a hole (not shown) through hood 553. A circular flange 5512 is provided in the middle of rod 551 stopped inside the hood 553, and a front end of the rod 551 terminates in a coupling portion 5511 extended out of the hood 553 and inserted through the pin hole 532 on the movable locating plate 53 into either hole 451 on the transmission plate 45. The spring 552 is mounted around the rod 551 and stopped between the circular flange 5512 and the inside wall of the hood 553 to give a pressure to the rod 551 causing the coupling portion 5511 to extend out of the hood 553. The rear end of the rod 551 is connected to the second control lever 51' through the second steel rope 52'. When the second control lever 51' is pulled, the rod 551 is pulled by the second steel rope 52' to compress the spring 552, causing the front coupling portion 5511 to disconnect from the transmission plate 45. When the second control lever 51' is released, the rod 551 is pushed out by the spring 552 causing the front coupling portion 5511 to again be coupled to the transmission plate 45.

Figure 4:
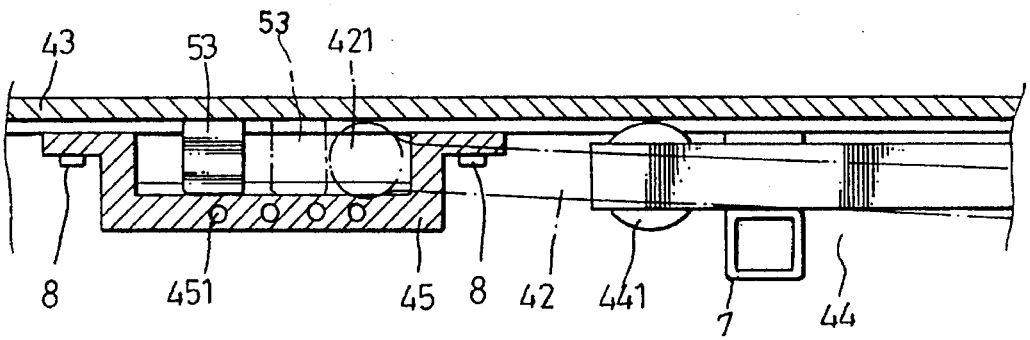
FIG. 4 is the adjusting mechanism of the foot sole massager, wherein the movable locating plate may be positioned at four different spots.
Figure 5:
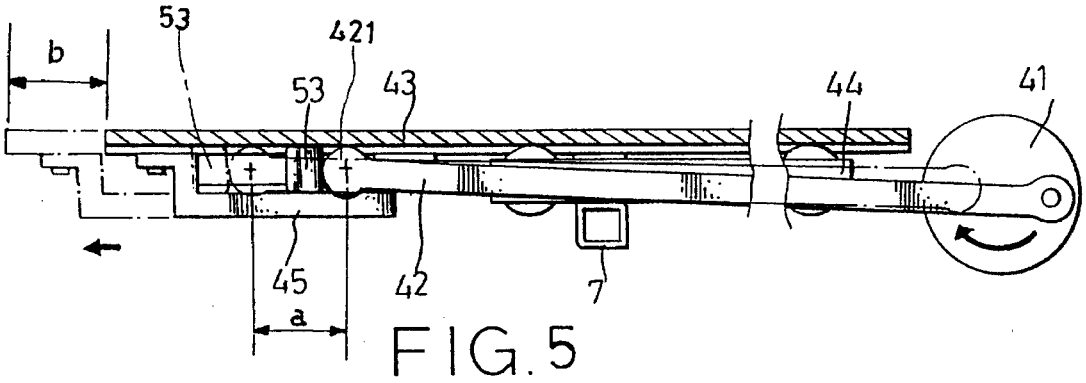
FIG. 5 shows the match between the adjusting mechanism and the driving mechanism according to the present invention, wherein the movable locating plate 53 is positioned at the spot shown by dotted lines in FIG. 4.
Figure 6:
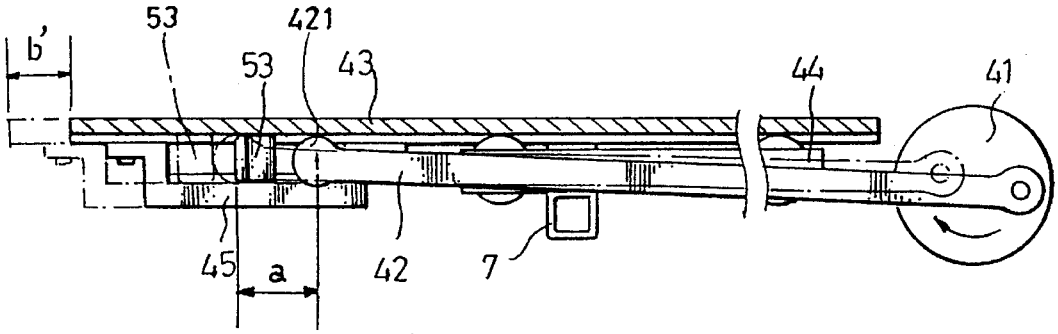
FIG. 6 shows the match between the adjusting mechanism and the driving mechanism according to the present invention, wherein the movable locating plate 53 is positioned at the spot as shown in FIG. 4.

Referring to FIG. 5 and FIG. 6, the roller 421 is driven by the motor 41 through the eccentric wheel 411 and the link 42, therefore the maximum moving range "a" of the roller 421 does not change. When the roller 421 is moved on the transmission plate 45, the slide plate 43 will be moved to the left only when the roller 421 touches the movable locating plate 53. When the roller 421 is moved between the right limit and the movable locating block 53, it does not cause the slide plate 43 to move. Therefore, by changing the position of the movable locating plate 53 (as shown in FIG. 4) on the transmission plate 45, the rolling distance of the roller 421 is changed, and the transverse moving range of the slide plate 43 is relatively changed. (It can be contrasted by the different moving distance "b" and "b'" of the slide plate 43 from FIG. 5 and FIG. 6.)

Referring to FIG. 1 and FIG. 2, when in use, the user needs only to stand on the massaging unit 3 and then turn on the driving mechanism 4. When the driving mechanism 4 is turned on, the soles of the user's feet are massaged by the first and second massaging elements 31 and 32. The control levers 51 and 51' of the adjusting mechanism 5 may be mounted on the uprights 24. By means of controlling the control levers 51 and 51', the reciprocating range of the slide plate 43 is changed and therefore, the turning angle of the first and second massaging rods 31 and 32 is relatively adjusted.

While only one embodiment of the present invention has been shown and described, it will be understood that various modifications and changes could be made without departing from the spirit and scope of the invention.

What is claimed is:

1. A foot sole massager, comprising:

a machine base including a central opening defined therein;

a massaging unit mounted in the central opening of the machine base, wherein the massaging unit includes a plurality of massaging rods mounted in the central opening;

a driving mechanism mounted on the machine base for rotating the massaging rods, wherein the driving mechanism includes a motor, a link having a first end connected with the motor, a roller located at a second end of the link, and a transmission plate to receive the roller; and an adjusting mechanism operatively connected with the driving mechanism for controlling a turning angle of the massaging rods, wherein the adjusting mechanism includes a movable locating plate and a clutch member, wherein the movable locating plate is moved by the roller of the driving mechanism, and the clutch member is used to connect and disconnect the movable locating plate from the transmission plate of the driving mechanism to thereby allow the location of the movable locating plate to be adjusted.

2. The foot sole massager of claim 1, wherein said massaging rods include first massaging rods and second massaging rods, each respectively molded from rubber, wherein the first massaging rods include a plurality of raised portions spaced over a periphery of the first massaging rods, and the second massaging rods each includes a plurality of tubular portions linked in parallel, each tubular portion having a longitudinal through hole.

3. The foot sole massager of claim 1, wherein said machine base includes a plurality of stands extending from a bottom thereof for supporting the machine base, wherein the central opening is equally spaced between two opposite side frames of the machine base, wherein a guard frame is provided across the central opening in parallel with said side frames, the guard frame having a series of mounting holes aligned with respective mounting holes on said side frames for mounting said massaging rods, and wherein the foot sole massager further includes two pairs of uprights extending from said side frames, wherein each pair of uprights is provided to support a handrail.

4. The foot sole massager of claim 3, wherein said massaging rods include first massaging rods and second massaging rods, each respectively molded from rubber, wherein the first massaging rods include a plurality of raised portions spaced over a periphery of the first massaging rod, and wherein the second massaging rods each includes a plurality of tubular portions linked in parallel, each tubular portion having a longitudinal through hole.

5. The foot sole massager of claim 1, wherein said driving mechanism includes an eccentric wheel mounted on an output terminal of the motor, a track mounted on two supporting frames at a bottom of said machine base and suspended below the central opening of said machine base, a slide plate having a top friction surface disposed in contact with said massaging rods and a bottom rail for moving along said track, wherein said link is coupled between said eccentric wheel and said slide plate and driven by said motor via said eccentric wheel to reciprocally move said slide plate along said track.

6. The foot sole massager of claim 1, wherein said driving mechanism includes:

an eccentric wheel mounted on an output terminal of the motor, a track mounted on two supporting frames at a bottom of said machine base and suspended below the central opening of said machine base, a slide plate having a top friction surface disposed in contact with said massaging rods and a bottom rail for moving along said track, wherein the link is coupled between said eccentric wheel and said slide plate and driven by said motor via said eccentric wheel to reciprocally move said slide plate along said track.

7. The foot sole massager of claim 6, wherein said adjusting mechanism includes:

a spring connected between said movable locating plate and said bottom rail of said slide plate, a first control lever connected with said movable locating plate through a first steel rope, wherein said first control lever adjusts a location of said movable locating plate to change a reciprocating range of said slide plate, wherein the clutch member is a spring supported clutch member, a second control lever connected with said clutch member through a second steel rope, wherein said clutch member is controlled by said second control lever to fasten said movable locating plate to said slide plate in any of a series of positions to control the reciprocating range of said slide plate.

8. A foot sole massager as set forth in claim 1, wherein said driving mechanism further includes a slide plate having a top friction surface which is disposed in contact with the massaging unit such that the massaging rods of the massaging unit are rotated when the slide plate is moved.

9. A foot sole massager as set forth in claim 8, wherein the slide plate includes a bottom rail to which the transmission plate is fastened.

10. A foot sole massager, comprising:

a machine base including a central opening define therein and two side frames arranged opposite one another;

a guard frame mounted across the central opening;

a massaging unit mounted in the central opening of the machine base, wherein the massaging unit includes a plurality of first massaging rods, wherein each first massaging rod is mounted on an axis which extends between the guard frame and one of the side frames, and a plurality of second massaging rods, wherein each second massaging rod is mounted on an axis which extends between the guard frame and one of the side frames, such that two rows of massaging rods are provided, one row on each side of the guard frame, wherein the first massaging rods include a plurality of raised portions spaced over a periphery of the first massaging rods, and wherein the second massaging rods each includes a plurality of tubular portions extending in the direction of the axis of the second massaging rods, wherein a longitudinal through hole is defined in each tubular portion so as to allow the second massaging rods to be elastically deformable;

a driving mechanism mounted on the machine base for rotating the first massaging rods and the second massaging rods, wherein the driving mechanism includes a motor, a link having a first end connected with the motor, a roller located at a second end of the link, and a transmission plate to receive the roller; and an adjusting mechanism operatively connected with the driving mechanism for controlling a turning angle of the first massaging rods and the second massaging rods, wherein the adjusting mechanism includes a movable locating plate and a clutch member, wherein the movable locating plate is moved by the roller of the driving mechanism, and the clutch member is used to connect and disconnect the movable locating plate from the transmission plate of the driving mechanism to thereby allow the location of the movable locating plate to be adjusted.

11. The foot sole massager of claim 10, wherein said machine base includes a plurality of stands extending from a bottom thereof for supporting the machine base, wherein the guard frame is mounted across said central opening in parallel with said side frames, said guard frame having a series of mounting holes aligned with respective mounting holes provided on said side frames for mounting said first and second massaging rods, and wherein the foot sole massager further includes two pairs of uprights extending from said side frames, wherein each pair of uprights is provided to support a handrail.

12. The foot sole massager of claim 10, wherein said machine base includes a plurality of stands extending from a bottom thereof for supporting the machine base, wherein the central opening is equally spaced between the two side frames, wherein the guard frame is disposed in parallel with said side frames and includes a series of mounting holes aligned with respective mounting holes on said side frames for mounting said massaging rods, wherein the foot sole massager further includes two pairs of uprights extending from said side frames, each pair of uprights provided to support a handrail.

13. The foot sole massager of claim 10, wherein said first massaging rods and second massaging rods are molded from rubber, wherein the tubular portions of the second massaging rods are linked in parallel.

14. A foot sole massager as set forth in claim 10, wherein the second massaging rods are made from rubber.

15. A foot sole massager as set forth in claim 14, wherein the first massaging rods are made from rubber.

16. A foot sole massager as set forth in claim 10, wherein the first massaging rods are made from rubber.

17. A foot sole massager as set forth in claim 10, wherein said driving mechanism further includes a slide plate having a top friction surface which is disposed in contact with the massaging unit such that the massaging rods of the massaging unit are rotated when the slide plate is moved.

18. A foot sole massager as set forth in claim 17, wherein the slide plate includes a bottom rail to which the transmission plate is fastened.

19. The foot sole massager of claim 10, wherein said driving mechanism includes:

an eccentric wheel mounted on an output terminal of the motor, a track mounted on two supporting frames at a bottom of said machine base and suspended below the central opening of said machine base, a slide plate having a top friction surface disposed in contact with said first and second massaging rods and a bottom rail for moving along said track, wherein the link is coupled between said eccentric wheel and said slide plate and driven by said motor via said eccentric wheel to reciprocally move said slide plate along said track.

20. The foot sole massager of claim 19, wherein said adjusting mechanism includes:

a movable locating plate, a spring connected between said movable locating plate and said bottom rail of said slide plate, a first control lever connected with said movable locating plate through a first steel rope, wherein said first control lever adjusts a location of said movable locating plate to change a reciprocating range of said slide plate, a spring supported clutch member, a second control lever connected with said clutch member through a second steel rope, wherein said clutch member is controlled by said second control lever to fasten said movable locating plate to said slide plate in any of a series of positions to control the reciprocating range of said slide plate.

* * * * *